US006905444B2

(12) United States Patent
Milton

(10) Patent No.: US 6,905,444 B2
(45) Date of Patent: Jun. 14, 2005

(54) ELASTIC SWIMMING EXERCISE DEVICE

(76) Inventor: Curtis A. Milton, 4429 Widgeon Way, Tallahassee, FL (US) 32303

( * ) Notice: Subject to any disclaimer, the term of this patent is extended or adjusted under 35 U.S.C. 154(b) by 111 days.

(21) Appl. No.: 10/083,287

(22) Filed: Feb. 26, 2002

(65) Prior Publication Data

US 2003/0162635 A1 Aug. 28, 2003

(51) Int. Cl.[7] ..... A63B 31/00

(52) U.S. Cl. ..... 482/55; 482/111; 482/124; 434/254

(58) Field of Search ..... 482/55, 56, 74, 482/111, 124, 125, 105, 148; 434/254

(56) References Cited

U.S. PATENT DOCUMENTS

| | | | | | |
|---|---|---|---|---|---|
| 2,825,224 | A | | 3/1958 | Lindenauer | |
| 3,512,416 | A | * | 5/1970 | Hohwart | 73/379.09 |
| 3,988,020 | A | | 10/1976 | Carter | |
| 4,095,657 | A | * | 6/1978 | Hohwart | 482/55 |
| 4,109,905 | A | | 8/1978 | Meier | |
| 4,247,096 | A | * | 1/1981 | Schmitt | 482/55 |
| 5,050,863 | A | * | 9/1991 | Yacoboski | 482/55 |
| 5,236,404 | A | * | 8/1993 | MacLennan | 482/55 |
| 5,344,373 | A | | 9/1994 | Greene | |
| 5,782,447 | A | * | 7/1998 | Hoffend | 248/227.1 |
| 5,813,641 | A | * | 9/1998 | Baldwin | 248/223.41 |
| 5,816,982 | A | | 10/1998 | Croushore | |
| 6,251,049 | B1 | | 6/2001 | Milton | |

* cited by examiner

*Primary Examiner*—Stephen R. Crow
*Assistant Examiner*—Tam Nguyen
(74) *Attorney, Agent, or Firm*—J. Wiley Horton

(57) ABSTRACT

A device for allowing a swimmer to exercise in a pool while remaining approximately in place. The device includes an adjustable belt which fits around the swimmer's waist. An elastic harness connects this belt to an anchor bracket which is fixed to the side of the pool. The harness elastically deforms as the user exerts greater swimming force, thereby indicating to the user his or her level of exertion. The anchor bracket in configured to attach to a pool incorporating a skim gutter.

2 Claims, 8 Drawing Sheets

ELASTIC SWIMMING EXERCISE DEVICE

FIELD OF THE INVENTION

This invention relates to the field of swimming exercise devices. More specifically, the invention comprises a restraining harness which allows the user to perform swimming strokes in a pool without moving significantly, and a mounting bracket allowing the attachment of the harness to certain types of pools.

DESCRIPTION OF THE PRIOR ART

This invention represents a refinement of my own prior invention. The prior invention, entitled "Elastic Swing Exercise Device", is the subject of U.S. Pat. No. 6,251,049. This disclosure hereby incorporates by reference U.S. Pat. No. 6,251,049.

Swimming restraint harnesses have been in use for some time. U.S. Pat. No. 3,988,020 to Carter (1976) discloses a belt harness intended to be anchored to the side of a pool. The harness has two inelastic cords attached to fixed anchor points. These anchor points must be drilled into the concrete near the edge of the pool. While effective in restraining the swimmer, the Carter device does require disfiguring the pool by installing two permanent anchor points. In addition, the harness assembly is substantially rigid. With a substantially rigid harness, it is difficult for the swimmer to know how much energy he or she is exerting. A preferable arrangement is to have an elastic member in the harness, so that as the swimmer strokes more vigorously, some forward progress is noted.

An elastic harness is disclosed in U.S. Pat. No. 4,109,905 to Meier (1978). The Meier device has a short elastic section near the anchor point which does allow some stretching of the harness. Unfortunately, however, the Meier device also requires a fixed anchor point. Additionally, the harness disclosed is rudimentary and impractical.

A more sophisticated harness is disclosed in U.S. Pat. No. 5,236,404 to MacLennan (1993). The MacLennan device uses a vest type life jacket as a harness, thereby distributing the load on the swimmer's body in a different fashion. The MacLennan invention also provides for attaching the harness to a pool ladder, eliminating the need for dedicated anchor points. The MacLennan device does not, however, have any elastic members in the harness. An additional drawback is that many pools do not have ladders, making it impossible to attach the device. Finally, the use of a vest type life jacket as a harness significantly restricts many swimming strokes.

U.S. Pat. No. 5,601,514 to Horn (1997) addresses the attachment problem with suction cups. This device uses two large suction cups on a substantially rigid plastic frame. The device is intended to work in compression though; i.e., the swimmer is trying to force his way toward the attachment point. This approach would not work if the swimmer swims in the other more conventional direction.

Finally, U.S. Pat. No. 5,816,982 to Croushmore (1998) discloses a radical approach to the anchoring problem. The Croushmore device discloses a collapsible bag used as an anchor. The swimmer fills the bag with water and then drags it up on the side of the pool. The bag anchors a mesh to which is attached the swimming harness. Of course, a swimmer can exert considerable force while exercising. Thus, the bag will need to be quite heavy in order to be an effective anchor. This fact means that the user will have to fill the bag with many pounds of water, making it quite difficult to drag up and over the side of the pool.

Anchoring issues have been further complicated by the introduction of a new type of pool. Traditional pools have a solid lip running around their perimeters (see FIG. 1 of U.S. Pat. No. 6,251,049). Pool water is pulled into the filtration system through several ports in the side of the pool. More modern pools—particularly larger pools at public facilities—often incorporate a skim gutter running around the entire perimeter. FIG. 1 of the present disclosure ilustrates this feature. Pool 10 incorporates skim gutter 16, which is separated from the bulk of the pool by gutter lip 64. The height of gutter lip 64 is set to be just below the water level in the pool. The pool circulation system is configured to pull water from skim gutter 62. As skim gutter 62 constitutes a trip hazard for swimmers entering the pool, it is often covered by a grate.

Pools employing the configuration illustrated in FIG. 1 present difficulties for the attachment of elastic exercise devices. The known devices for restraining a swimmer while exercising are limited in that they:

1. Do not provide sufficient elastic extension of the harness in order to allow the swimmer to gauge his or her level of exertion;
2. Require the placement of permanent anchor points in the pool;
3. Require the presence of a pool ladder;
4. Encumber the user in the swimming exercise;
5. Require the lifting of a heavy bag or other type of anchor; and
6. Are not adaptable to a pool incorporating a skim gutter.

BRIEF SUMMARY OF THE INVENTION

A system for allowing a swimmer to exercise in a pool while remaining approximately in place. The device includes an adjustable belt which fits around the swimmer's waist. An elastic harness connects this belt to an anchor bracket which is fixed to the side of the pool. The harness elastically deforms as the user exerts greater swimming force, thereby indicating to the user his or her level of exertion. The anchor bracket in configured to attach to a pool incorporating a skim gutter.

Accordingly, several objects and advantages of the present invention are:

1. To provide sufficient elastic extension of the harness in order to allow the swimmer to gauge his or her level of exertion;
2. To eliminate the need for permanent anchor points in the pool;
3. To eliminate the need for a pool ladder;
4. To not encumber the user in the swimming exercise;
5. To eliminate the need for an inordinately heavy anchor; and
6. To provide a means of attachment to a pool incorporating a skim gutter.

REFERENCE NUMERALS IN THE DRAWINGS

Figure 1:
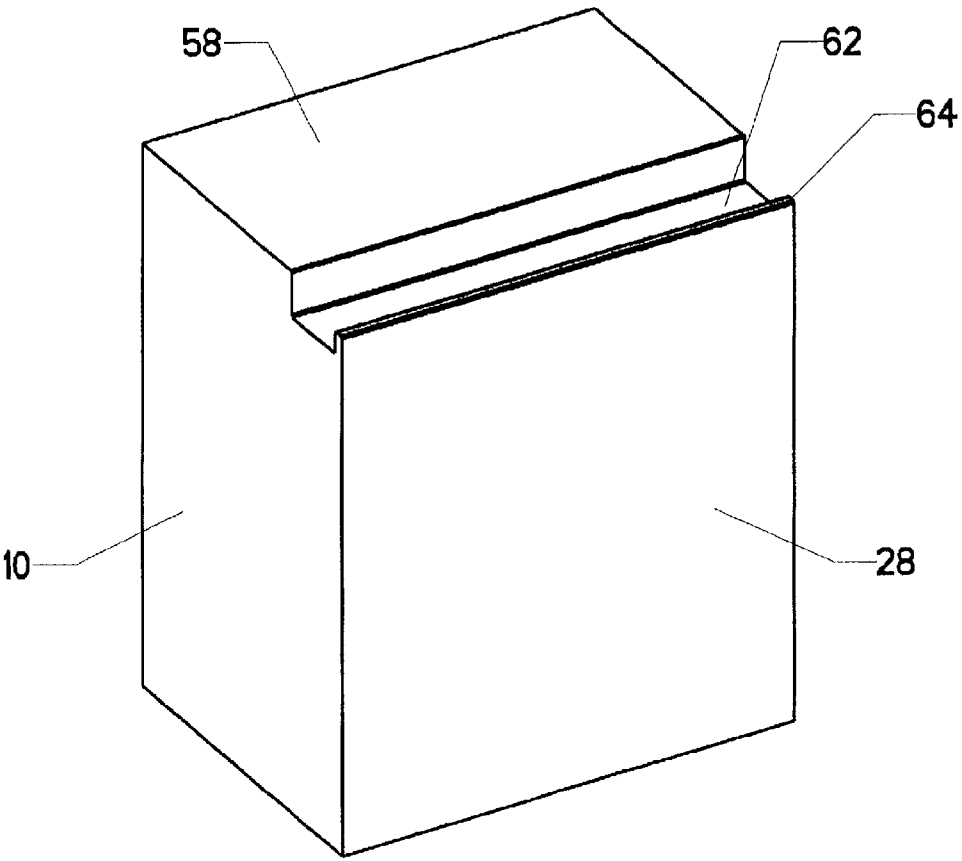
FIG. 1 is an isometric view, showing a swimming pool incorporating a skin gutter.

10 pool
16 belt harness
18 flex bow
20 flexible line
28 pool side
32 collector ring
36 belt
46 trailing line
48 harness union
50 harness leader
58 pool apron
62 skim gutter
64 gutter lip
66 anchor bracket
68 rear wall
70 front wall
72 top wall
74 boss
76 right attach point
78 center attach point
80 left attach point
82 clamp assembly
84 pad
86 base
88 threaded shaft
90 handle
92 split leader
94 slot
96 securing strip

DESCRIPTION OF THE INVENTION

FIG. 1 shows a portion of pool 10. Pool side 28 contains the water within the pool. Pool apron 58 is the area where swimmers walk around prior to entering the pool. The particular type of pool shown incorporates skim gutter 62 running around its perimeter. Skim gutter 62 is bounded on one side by pool apron 58 and on the other side by gutter lip 64. Gutter lip 64 has an inner surface (facing skim gutter 62), atop surface, and an outer surface. Its top surface lies just beneath the water level.

The pool's fluid circulation pumps draw water from skim gutter 62. Thus, the upper layer of water in the pool tends to flow over the top of gutter lip 64 into skim gutter 62, and from there into the circulation pumps. As skim gutter 62 constitutes a tripping hazard, it is often covered by a grate which lies flush with the top surface of gutter lip 64.

Figure 2:
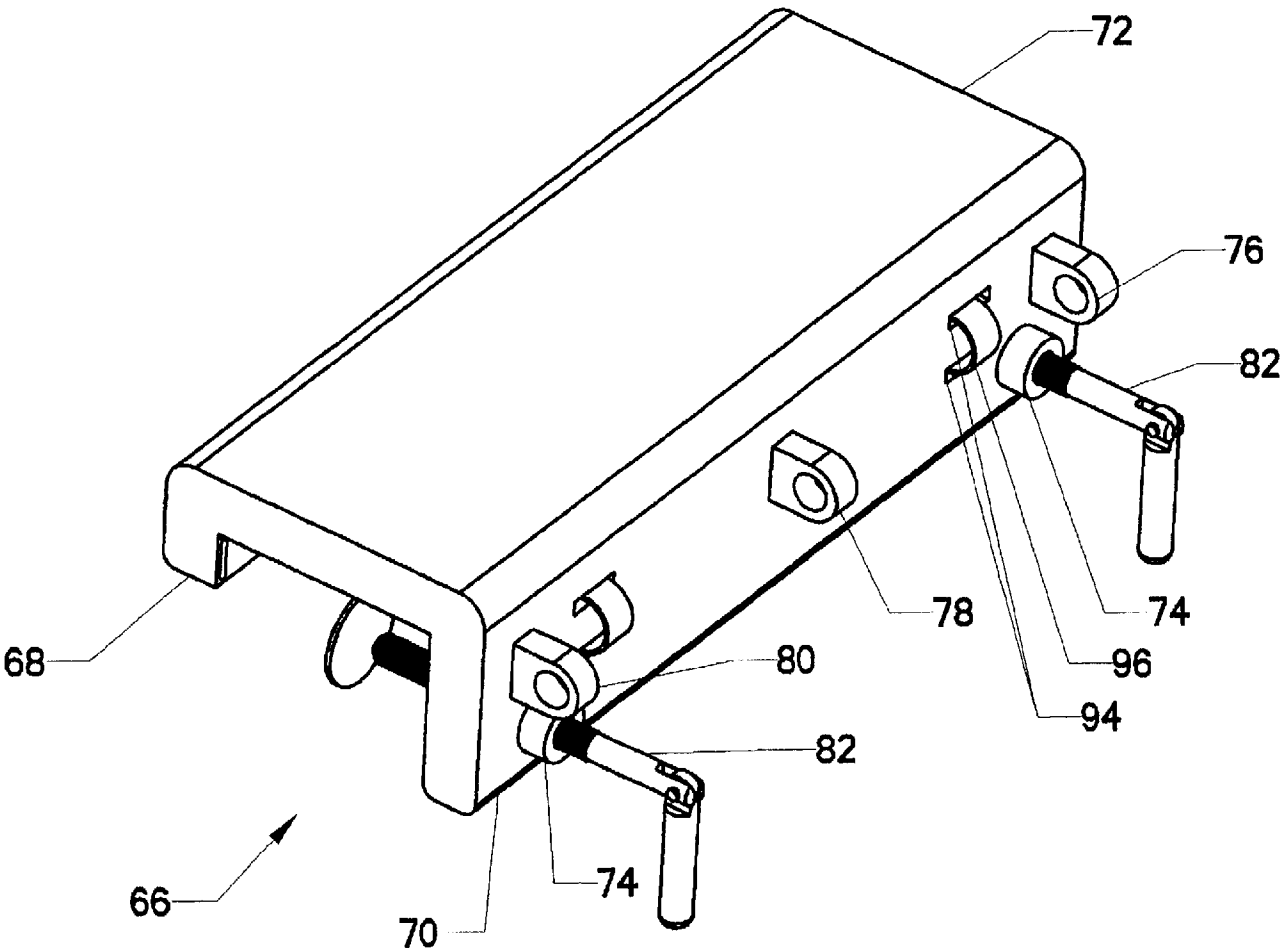
FIG. 2 depicts the anchor bracket employed in the present invention.

Attaching an exercise device to the type of pool shown in FIG. 1 can be difficult. The present invention incorporates a device to overcome this difficulty. FIG. 2 depicts anchor bracket 66. It includes rear wall 68, top wall 72, and front wall 70. In operation, top wall 72 fits over the top surface of gutter lip 64. Rear wall 68 is then positioned to bear against the inner surface of gutter lip 64.

Front wall 70 incorporates two bosses 74. These include female threads for the mounting of two clamping assemblies 82. When anchor bracket 66 is placed over gutter lip 64, the two clamping assemblies 82 are tightened so that they clamp against the outer surface of gutter lip 64, thereby locking anchor bracket 66 in position. Front wall 70 also incorporates additional features for the attachment of swimming exercise devices. Right hand attach point 76, center attach point 78, and left attach point 80 are all available at the user's option.

Figure 3:
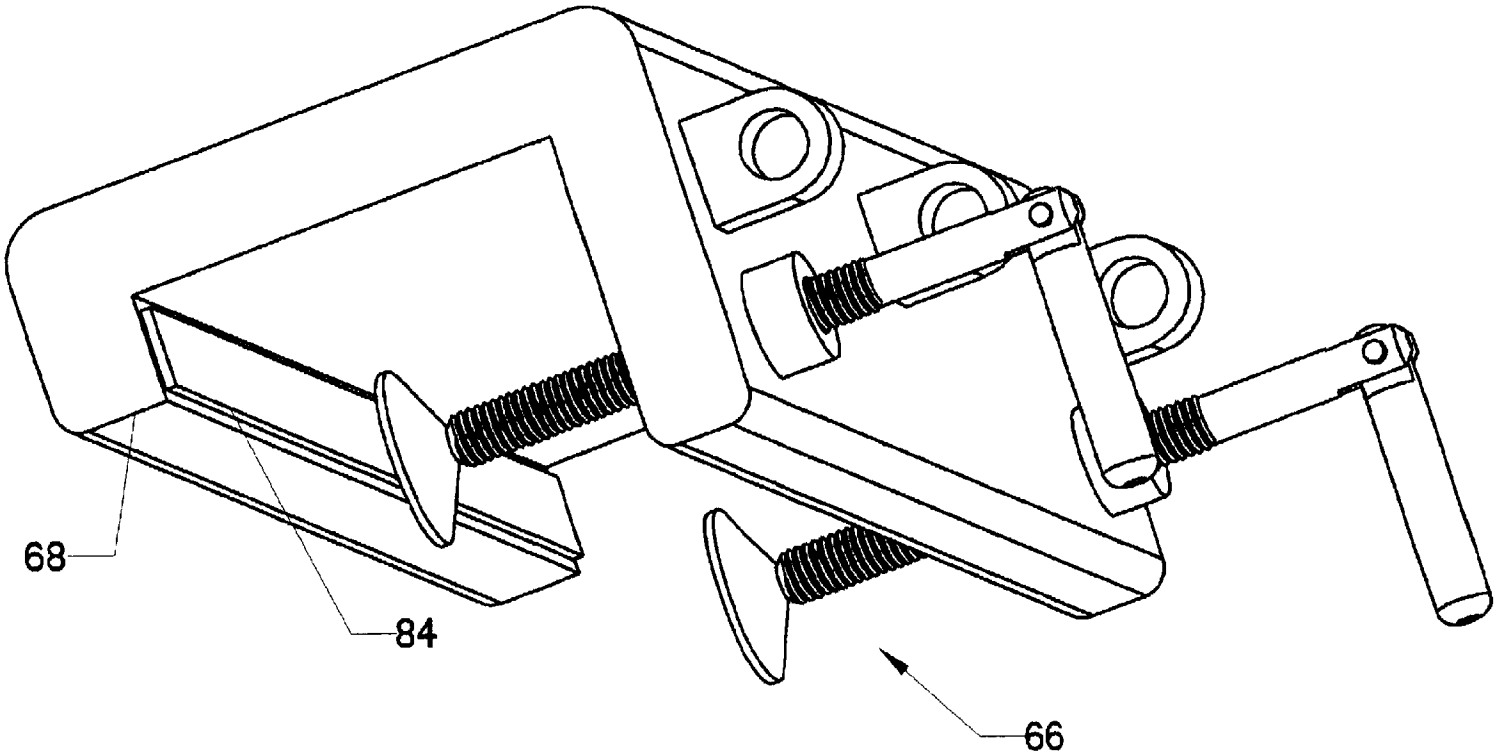
FIG. 3 depicts the anchor bracket from a different perspective.

FIG. 3 shows anchor bracket 66 from a different perspective. The reader will observe that the inner facing surface of rear wall 68 is covered by pad 84. Pad 84 prevents the marring of gutter lip 64 when the device is locked in place.

Figure 4:
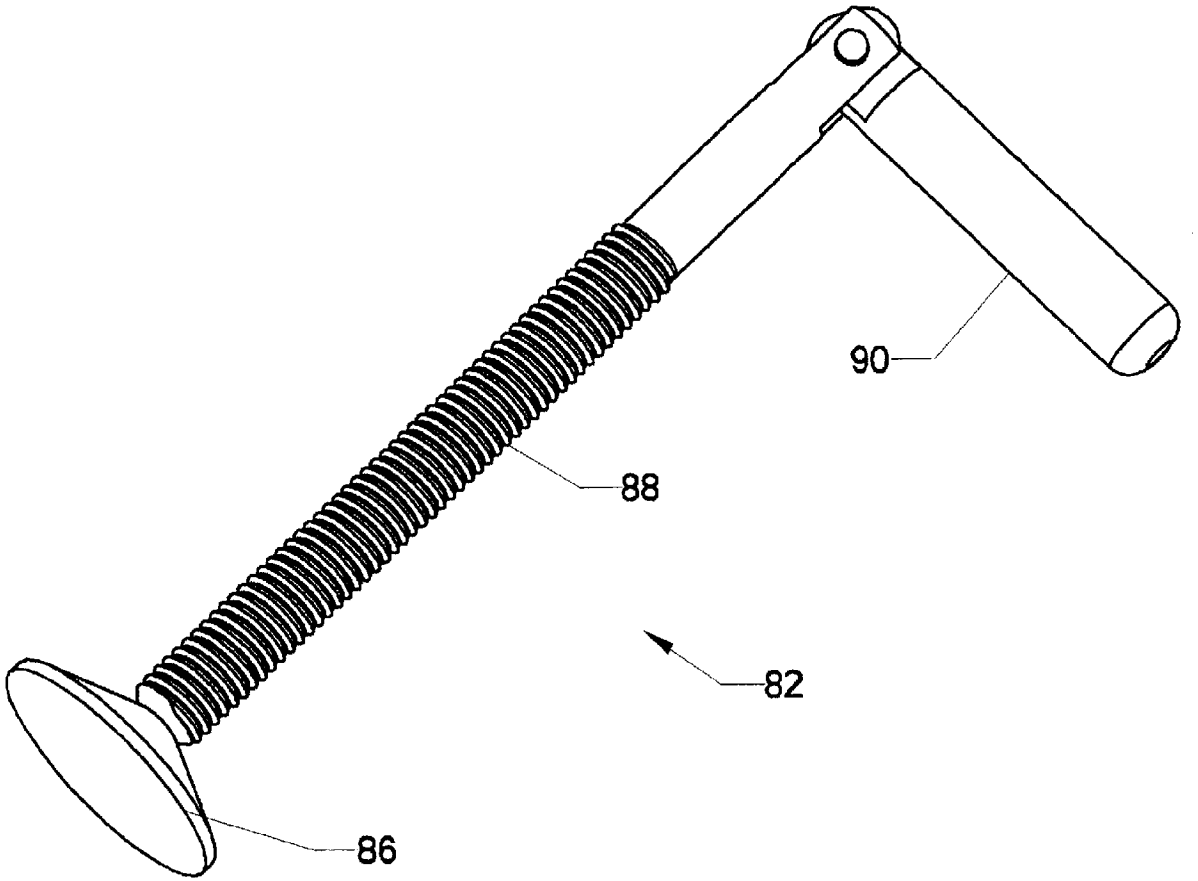
FIG. 4 is an isometric view showing a clamp assembly.
Figure 5:
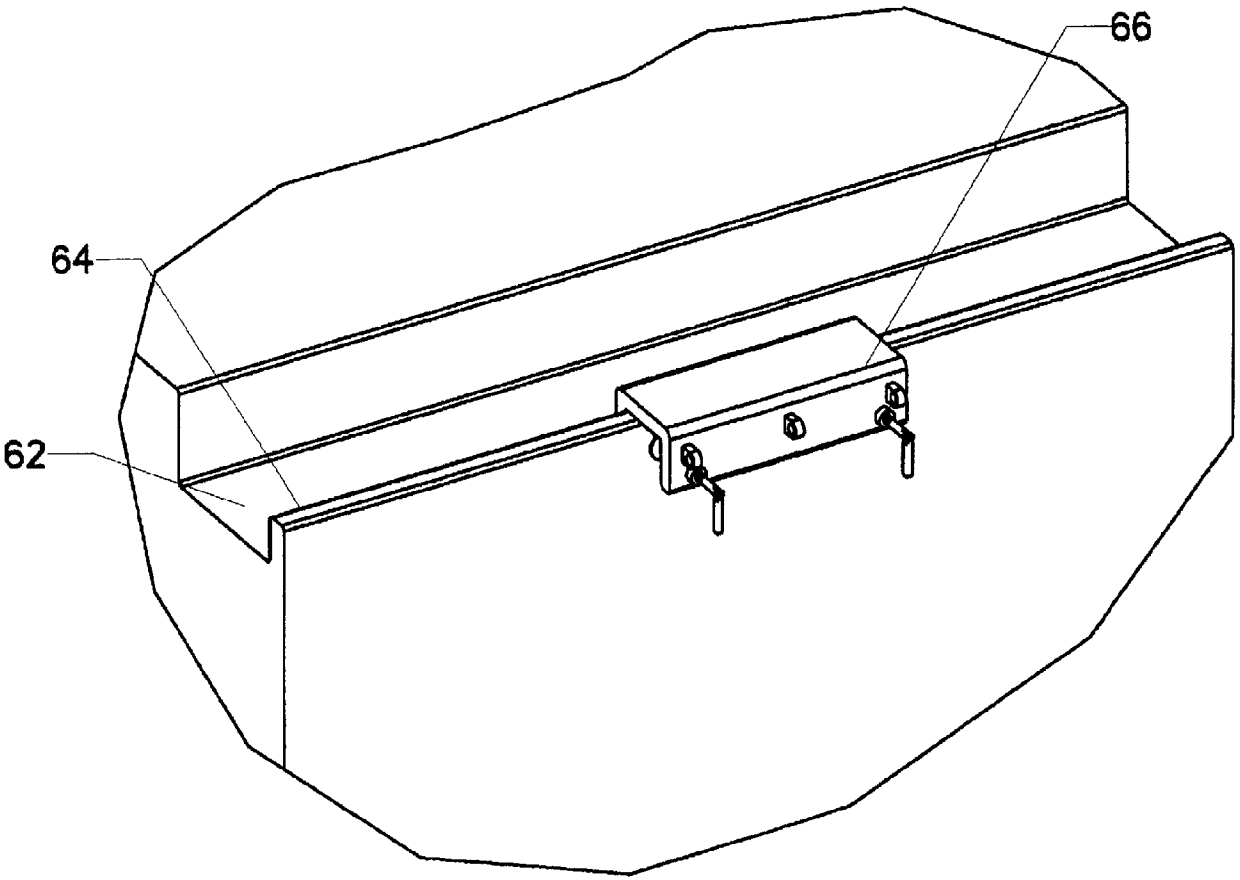
FIG. 5 is an isometric view showing the anchor bracket attached to a pool.

FIG. 4 shows some details of clamp assembly 82. Its primary element is threaded shaft 88. Base 86 is located on its inward-facing extremity. Base 86 is free to rotate with respect to threaded shaft 88. As threaded shaft 88 is turned within boss 74, base 86 does not rotate. This feature minimizes marring of the outer surface of gutter lip 64 as clamp assembly 82 is tightened. Base 86 is preferably provided with a pad to further minimize marring. Handle 90 is provided so that the user can tighten clamp assembly 82 without the need for tools. FIG. 5 shows anchor bracket 66 clamped in position on gutter lip 64.

Figure 6:
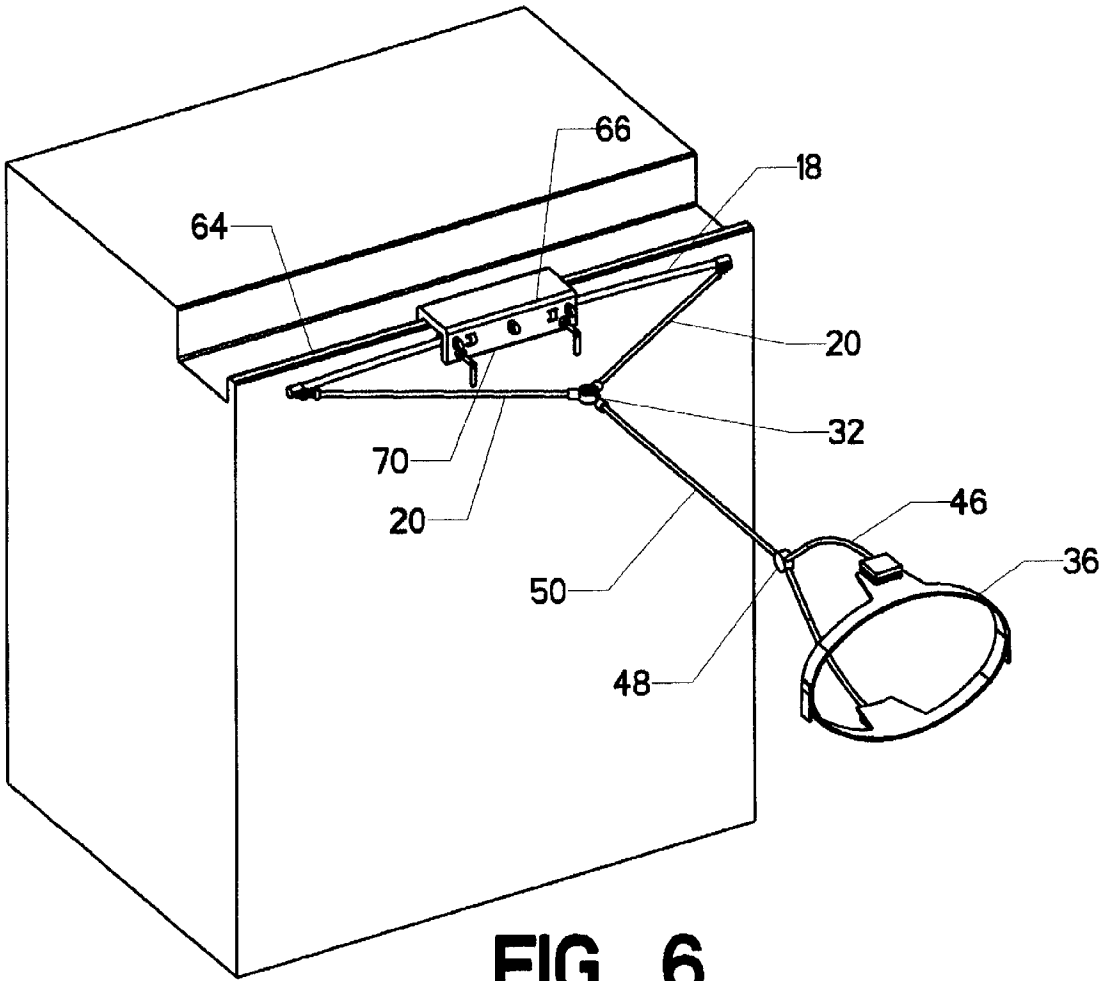
FIG. 6 is an isometric view showing a first type of exercise device attached to the anchor bracket

A variety of swimming exercise devices can be attached to anchor bracket 66. FIG. 6 shows an elastic device as previously disclosed in my own U.S. Pat. No. 6,251,049 (2001). In this configuration, flex bow 18 is placed between gutter lip 64 and front wall 70 of anchor bracket 66. Flex bow 18 may also be placed above the two threaded shafts 88, so that it is locked in position. Additional securing means are also preferably provided. Returning now to FIG. 2, the reader will observe that front wall 70 is pierced by two sets of slots 94. An elastic securing strap 96 resides within the slots 94. A loop of each securing strap extends behind front wall 70. These two loops secure flex bow 18 in place. The loops can be provided with an opening (preferably closed by VELCRO) to aid in the installation and removal of flex bow 18.

As described in my prior patent, flex bow 18 is capable of substantial elastic deformation. Returning now to FIG. 6, the reader will observe that its two ends are attached via two flexible lines 20 to collector ring 32. Collector ring 32 is attached to harness leader 50 which, in turn, attaches to two trailing lines 42. Trailing lines 42 are attached to belt 36, which is affixed around the swimmer's waist. The various lines described can be made of elastic tubing to provide an even greater elasticity in the device as a whole. This elasticity is a desired feature, since it allows the swimmer to gauge his or her level of exertion according to the total elongation of the device.

The use of anchor bracket 66 allows the use of flex bow 18 in pools that don't have a ladder or other convenient anchoring point for the flex bow. Thus, the configuration shown in FIG. 6 represents the preferred embodiment.

Figure 7:
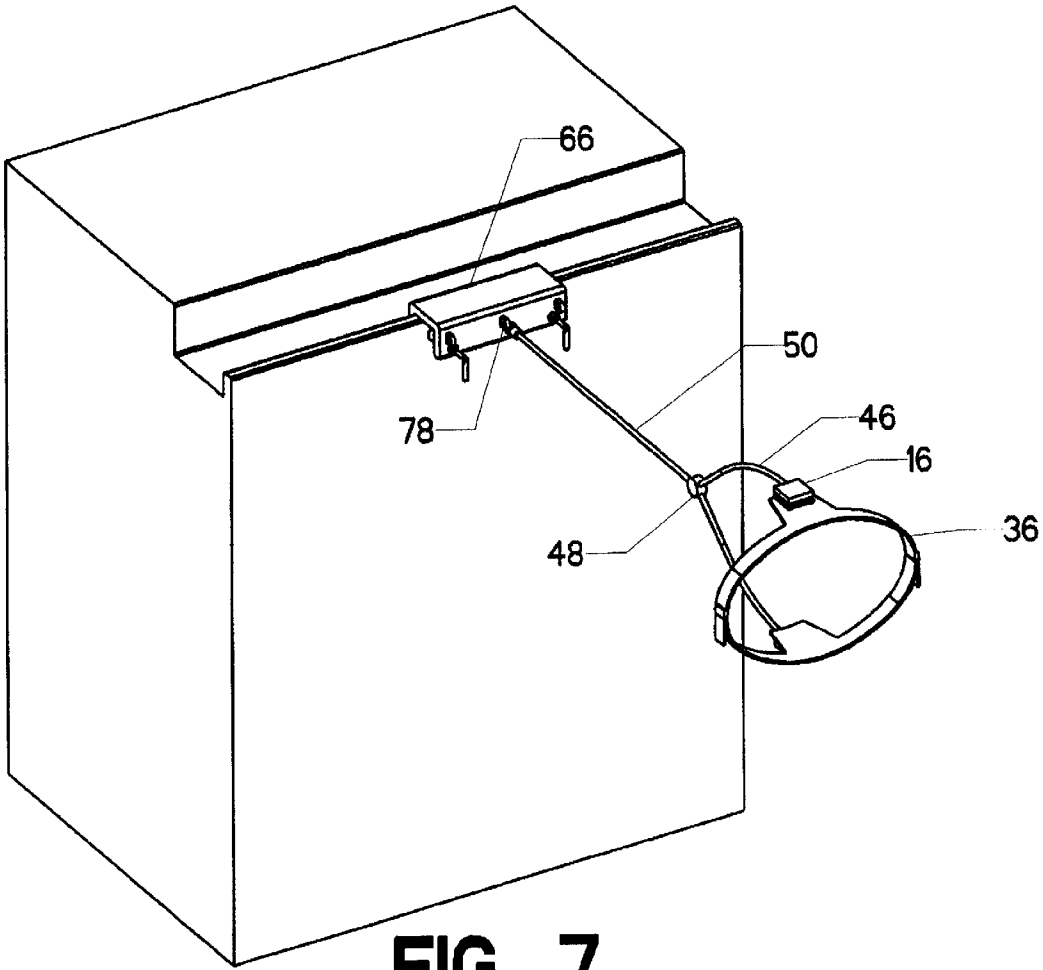
FIG. 7 is an isometric view showing a second type of exercise device attached to the anchor bracket.

FIG. 7 illustrates another embodiment in which flex bow 18 is not used. In this embodiment harness leader 50 is simply attached to center attach point 78 on anchor bracket 66. Harness leader 50 is preferably made of elastic material. Although this configuration possesses less elasticity than the embodiment shown in FIG. 6, it is simpler to install.

Figure 8:
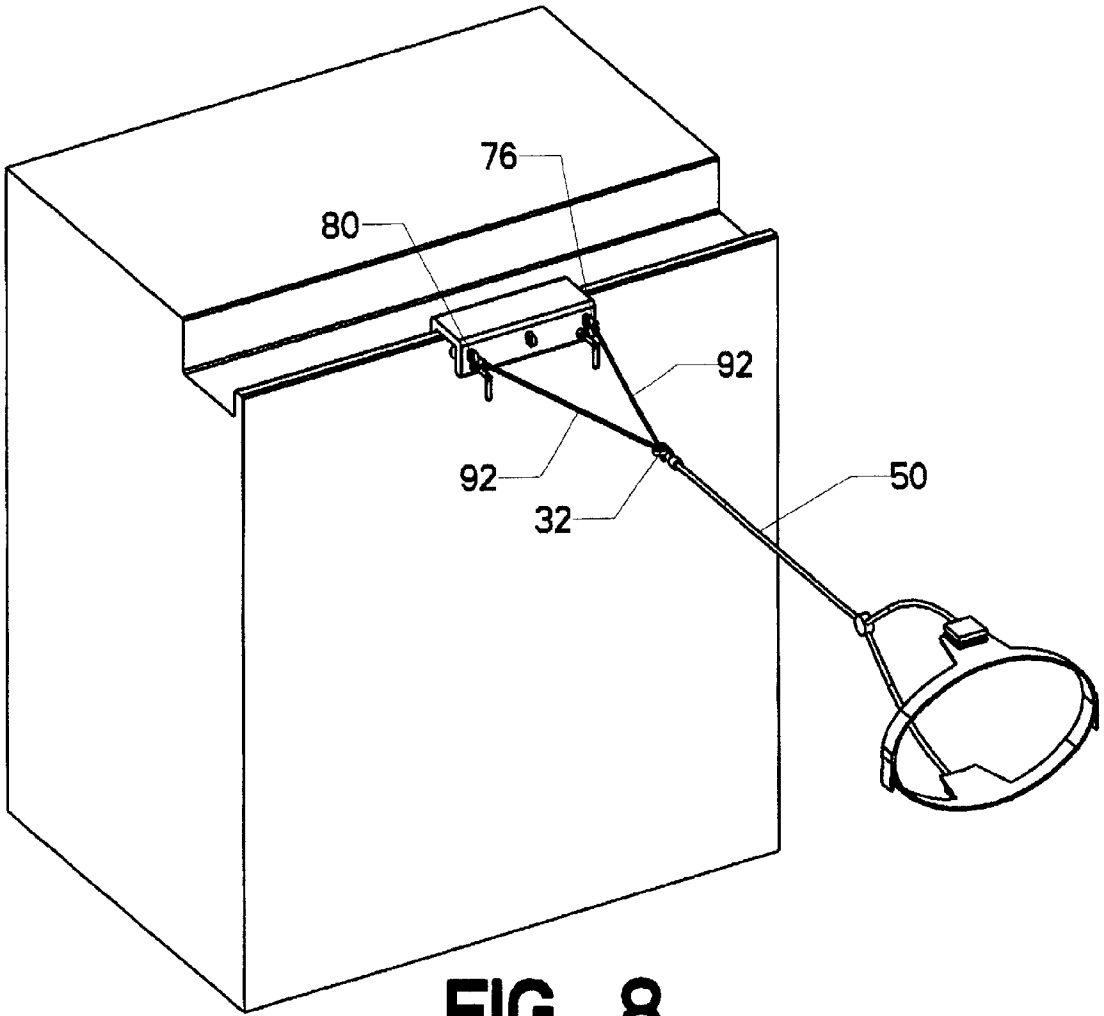
FIG. 8 is an isometric view showing a third type of exercise device attached to the anchor bracket.

FIG. 8 shows another embodiment having more elasticity than the one shown in FIG. 7. Two split leaders 92 are attached to right attach point 76 and left attach point 80, respectively. The two split leaders 92 are then attached to collector ring 32. Provided that elastic materials are used for the split leaders, this configuration provides greater elasticity.

Accordingly, the reader will appreciate that the proposed invention allows a swimmer to exercise within a pool without moving significantly, yet still allows the swimmer to gauge his or her level of exertion. The invention has further advantages in that it:

1. Eliminates the need for permanent anchor points in the pool;
2. Eliminates the need for a pool ladder;
3. Does not encumber the user in the swimming exercise;
4. Eliminates the need for an inordinately heavy anchor; and
5. Allows the use of an exercise device in a pool having a skim gutter.

Although the preceding description contains significant detail, it should not be construed as limiting the scope of the invention but rather as providing illustrations of the preferred embodiments of the invention. Thus, the scope of the invention should be fixed by the following claims, rather than by the examples given.

Having described my invention, I claim:

1. A swimming exercise apparatus intended to maintain a swimmer relatively stationary in a pool, wherein said pool includes a skim gutter and a gutter lip having an inner surface facing said skim gutter and an outer surface facing away from said skim gutter, comprising:

a) an anchor bracket, comprising:

i) a rear wall, configured to be placed against an inner surface of a gutter lip of a swimming pool;

ii) a front wall, configured to be placed proximate an outer surface of said gutter lip;

iii) a top wall, attaching said rear wall to said front wall; and iv) clamping means for clamping said rear wall tightly against said inner surface of said gutter lip, so as to secure said anchor bracket to said gutter lip;

b) a belt harness attached to a swimmer around said swimmer's waist;

c) a flex bow, having a first end and a second end, and being placed between said front wall of said anchor bracket and said gutter lip, wherein said flex bow is substantially elastic so that as said swimmer exerts swimming force said first and second ends of said flex bow will deflect substantially toward said swimmer;

d) a first flexible line, having a first end and a second end, wherein said first end is attached to said first end of said flex bow and said second end is connected to said belt harness; and e) a second flexible line, having a first end and a second end, wherein said first end is attached to said second end of said flex bow and said second end is connected to said belt harness, so that as said swimmer attempts to swim away from said anchor bracket said first and second flexible lines are placed in tension, said flex bow is drawn against said front wall of said anchor bracket, and said flex bow begins to bow.

2. The device as recited in claim 1, wherein said flex bow is a long slender rod, capable of bending substantially without undergoing plastic deformation.

* * * * *